US005578275A

United States Patent [19]

Rosenberg et al.

[11] Patent Number: 5,578,275

[45] Date of Patent: Nov. 26, 1996

[54] IN-LINE SAMPLING WITH CONTINUOUS FLUSHING FOR FRICTION SENSITIVE LIQUID NITRATE ESTER COMPOSITIONS

[75] Inventors: Steven J. Rosenberg, Flanders; Shpend Ismaili, Hasbrouck Hts., both of N.J.; Eldon K. Hurley, Wilmington, Del.; Thomas H. Langford, Salisburg, N.C.

[73] Assignee: The United States of America as represented by the Secretary of the Army, Washington, D.C.

[21] Appl. No.: 390,458

[22] Filed: Feb. 16, 1995

[51] Int. Cl.[6] ..... B01F 7/08

[52] U.S. Cl. ..... 422/163; 422/100; 73/863.41; 147/2; 147/109.6

[58] Field of Search ..... 422/163, 100; 73/863.41, 35; 149/109.6, 2

[56] References Cited

U.S. PATENT DOCUMENTS

| | | | |
|---|---|---|---|
| 2,368,638 | 2/1945 | Bryce et al. | 422/163 |
| 4,472,215 | 9/1984 | Binet et al. | 149/109.6 |
| 4,767,476 | 8/1988 | Jürgen | 149/109.6 |
| 5,143,699 | 9/1992 | Herter | 422/163 |

*Primary Examiner*—Nina Bhat

*Attorney, Agent, or Firm*—Saul Elbaum; Edward Goldberg; John E. Callaghan

[57] ABSTRACT

A sampling system with a remotely operable, in-line sampler with continuous flow of sample flush water is described. The device is used in the production of friction sensitive liquid nitrate esters, particularly nitroglycerin and diethylene glycol dinitrate.

11 Claims, 8 Drawing Sheets

IN-LINE SAMPLING WITH CONTINUOUS FLUSHING FOR FRICTION SENSITIVE LIQUID NITRATE ESTER COMPOSITIONS

GOVERNMENTAL INTEREST

The invention described herein may be manufactured, used and licensed by or for the U.S. Government without payment to us of any royalties.

BACKGROUND OF THE INVENTION

The present invention relates to equipment and methods for the sampling of friction sensitive liquid nitrate esters during the manufacture, transfer or storage of the same. The materials of principal concern are nitroglycerine and diethylene glycol dinitrate. These materials are known to be extremely sensitive to friction. This extreme sensitivity has meant that the transport or processing of the esters can be very hazardous because any accumulations of stagnant nitroglycerine or diethylene glycol dinitrate can lead to detonation from the slightest friction. Therefore, improvements in sampling are an important contribution to this field. Nitroglycerin grades that satisfy military specifications are manufactured under exacting specifications. One result is that the acceptance testing process for the nitroglycerin is itself covered by a specification. Because the material is very sensitive to friction, the sampling, on one hand, needs to accurately represent the material, and on the other hand, needs to be a safe method for personnel who perform it or who are in the vicinity of the manufacturing facility. The current specification for acceptance testing of liquid nitrate esters such as nitroglycerin (NG) at ammunition plants involves the production of a 5000 lb lot from which a small quantity of NG is educted for analysis. This technique has several drawbacks. One disadvantage is that 5000 lbs of NG must first be produced and stored for acceptance testing. In some plants, this quantity will require two hours of production which will result in a large quantity of explosive being held prior to it being declared acceptable for use. There is a further concern as to whether the educted sample taken from the five thousand pound storage lot of NG is a true representation of the contents of the storage tank. The NG is usually transported and stored in the form of an emulsion of NG in water or a solution of soda in water. A safe reliable sampling technique will can save time and expense in the production of NG. A related material is diethylene glycol dinitrate. Of the liquid nitrate esters, nitroglycerin and diethyl glycol dinitrate, are the most sensitive to friction. Although there is substantial experience in the manufacture, storage and transportation of these extremely friction sensitive liquid nitrate esters, the problem of accidental explosions still occurs in the facilities for the manufacture and storage of the NG and DEGDN.

SUMMARY OF THE INVENTION

The present invention is a production facility for these esters with a sampling system that features a remotely-operable, in-line sampler which includes a continuous flow of flush water to carry off samples, no direct metal to metal contact in the presence of the nitrate ester compositions and which has essentially one moving part in the form of a rubber membrane. The sampler is constructed from a single block of stainless steel so that it has no joints or crevices which could trap or accumulate stagnant NG or DEGDN. The present invention also provides a process for sampling which can have variable sampling cycles.

The invention is capable of taking small, individual samples having a volume in the range of about 20–70 milliliters (ml.) and these samples can be combined to form composite samples. The sample cycle can be varied both as to frequency of sampling and as to the size of the individual samples. The sampler and the sampling process are safe to operate, increase the safety of the production or storage facility and increase the safety of the sampling process. It can be practiced in a mode of continuous sampling of the product as the product is produced. It does not require bulk storage of nitroglycerine for the sole purpose of NG acceptance testing. The sampler of the present invention can provide both instantaneous and composite samples of NG as it is produced and this will be an accurate representation of the liquid nitrate ester production product. Thus, it is a suitable alternative to the eduction of samples from storage for production testing.

The sampler installation and the sampling process are designed for remote operation which will reduce dangers to personnel from exposure to liquid nitrate ester and dangers to personnel in the event of accidents or mishaps. The sampler is easy to inspect, service, disassemble and clean. Its construction and materials are compatible with the transfer of friction sensitive liquid nitrate ester in the form of a water emulsion. The practice in U.S. Government facilities is to use emulsions with a water/nitrate ester ratio of about 3:1.

Among the other advantages of the invention are: a sampling system which minimizes the friction applied to a friction sensitive liquid nitrate ester, a liquid nitrate ester product sampler which will operate "on line" and without the necessity of obtaining a large quantity of friction sensitive liquid nitrate ester product for testing and sampling, and the provision of a sampler for liquid nitrate ester product which uses a control system based on pressurized water. It is particularly intended to apply the invention to sampling for production, transportation and storage activities with nitroglycerin and diethylene glycol dinitrate, especially to compositions of these materials in the form of emulsions in water and emulsions in water-soda solutions.

BRIEF DESCRIPTION OF THE FIGURES

The accompanying

FIG. 1 is a view of the sampler used in the invention; it is in perspective and from the bottom.

FIG. 2 is a partial elevation of the sampler of FIG. 1.

FIG. 3 is a view of the upper part of the sampler of FIGS. 1 and 2; it is in perspective and from the bottom.

FIG. 4 is a top view of the lower part of the sampler of FIGS. 1–3.

FIG. 5 is an exploded view of the sampler of FIGS. 1–4; it is in perspective and from the bottom.

FIG. 6 is a schematic flow diagram illustrating the sampling process and a sampler installation according to the invention.

FIG. 8 is a diagrammatic view of the sampler system of the invention with its control instrumentation as it may be installed and used in a plant to manufacture nitroglycerine.

DETAILED DESCRIPTION OF THE INVENTION

In general, the sampler is a remotely operable, in-line sampler device for taking samples of the extremely friction sensitive liquid nitrate ester compositions of nitroglycerine and diethyl glycol dinitrate. The sampler has a flow-through chamber with an offtake line, a moveable rubber membrane and a continuous flush chamber; the membrane is the only moving part in the sampler. The flow-through chamber is in-line with the transfer line; the offtake line is of very small volume and diameter relative to the flow-through chamber and the continuous flush chamber. The membrane is moveable from a closed position at which it closes the bottom of the offtake line and an open position at which a predetermined amount of sample is released from the offtake line into the flush chamber. In the flush chamber, there is a continuous flow of water to create a continuous flushing action which will carry off samples for collection. The flush chamber is positioned to receive any sample of liquid nitrate ester released from the offtake line when the membrane is in the open portion and to flush over and around the side of the membrane when the membrane is in the closed position. This is a positive, continuous flushing action to prevent accumulation of stagnant masses of nitroglycerine or the like. A collector is connected to the sampler for collection of the flush effluent which can then be subjected to the analyses as may be required in the product specification.

Figure 1:
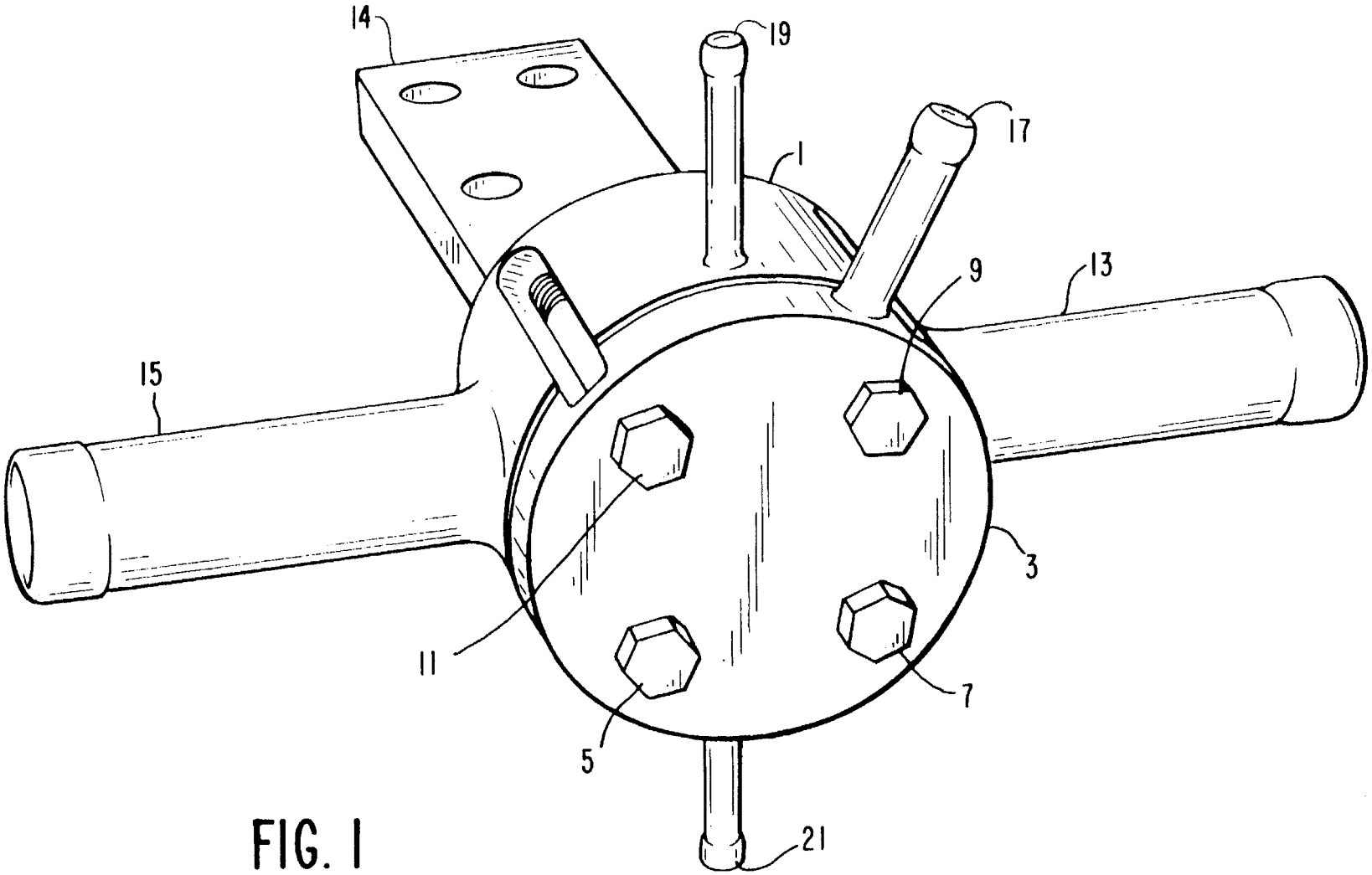
FIGS. 1–8 are intended to illustrate the practice of the invention.
Figure 2:
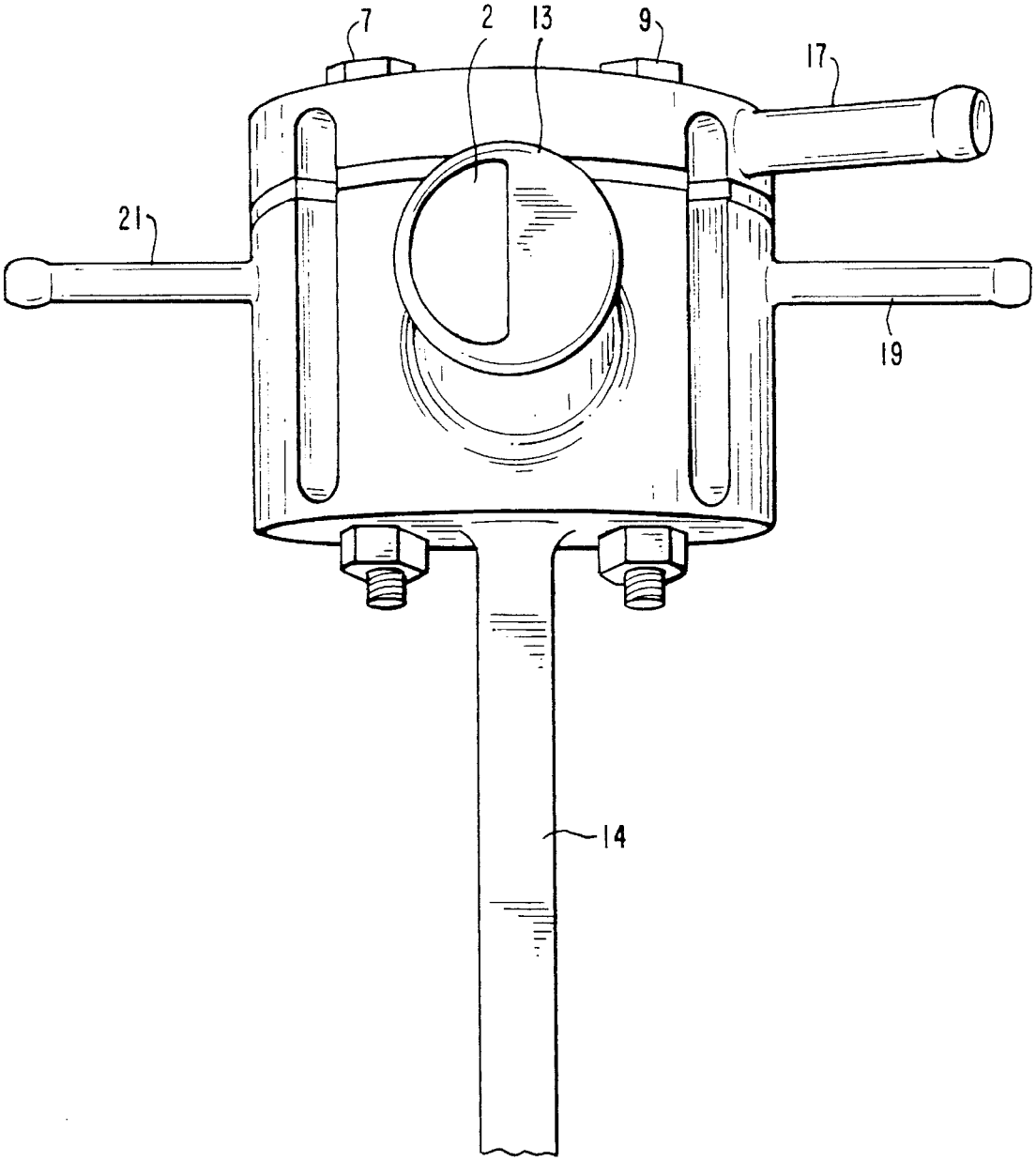

As shown in FIGS. 1 and 2, the sampler has a top section or body 1 and a bottom section or cover 3. The top section will contain the flow-through chamber, the offtake line and the flush chamber. The bottom section will contain the membrane. The membrane is not shown in FIGS. 1 and 2.

For service in a plant producing NG, the sampler must be of very heavy duty construction so as to be explosion-proof in the event of an accident. This can be seen from the relative dimensions shown in FIGS. 1–5. It should have no metal to metal joints in the surfaces that are in contact with the liquid nitrate ester compositions. For this purpose both the body 1 and the cover 3 are fabricated from a single block of well-polished stainless steel. This eliminates the presence of holes or crevices that can trap or accumulate stagnant NG.

A rubber membrane is located between the sampler body 1 and the cover 3. The assembly of body, membrane and cover are bolted together by four stainless steel nuts and bolts 5, 7, 9 and 11. These are safety wired for positive attachment. A mounting support or bracket 14 is located on the top of the body. The support 14 has holes for mounting the sampler to supports or the like so that it is in position with the transfer line of the liquid nitrate ester product. As shown, the support is a separate piece of metal, stainless steel, which is welded to the body. Other orientations are also feasible.

Ports 15 and 13 are the input and output lines of the flow-through chamber. These meet in the middle of the body and form a short pipeline so that the sampler can be connected to and act as a section of a transfer line containing liquid nitrate ester in a solution of water and soda. This emulsion is a mixture of nitroglycerine in water and soda; it is made up to reduce acidity in the NG. As the composition moves in the flow-through chamber, a portion circulates into the offtake line. Samples will be drawn from the offtake line.

The continuous flush-chamber has an inlet port 19 and an outlet port 21. Overall, the flush-chamber is located to surround the offtake line. The inlet port 19 is the source of the continuous flush water which will be flowing through the flush-chamber. The output port 21 is the discharge line from the chamber and connects to an exit line which will transport the NG sample to a remote location for analysis. The flush-chamber has an annular cavity that is open at the bottom. This is in contact with the face side of the membrane and will communicate with the offtake line when the membrane is in the open position. In the closed position, the membrane is in contact with the bottom of the flush chamber. The area of surface contact between the membrane and the chamber is sufficient for a good seal when the membrane is in the closed position. The flush water flows continuously through the flush chamber whether the membrane is open or closed.

In the cover or bottom section 3, there is another control port 17 which contains pressurized water that can be used to control the position and movement of the membrane. By increasing or decreasing the pressure on the water in contact with the membrane to pressures above or below that of the liquid in the transfer line and the offtake line, the position of the membrane relative to the flush-chamber and offtake line is controlled to allow for the taking of samples. When the pressure is decreased, the membrane can move away from the body and into a depression in the cover which opens the flow of sample from the bottom of the offtake line. When pressure is increased, the membrane moves against the body and seals the offtake line. The moving flush water will carry the sample out to the collection apparatus.

There is substantial risk of accident or mishap in the production of nitroglycerine and diethylene glycol dinitrate because of their extreme sensitivity to friction. It is an important feature of the invention that it has essentially only one moving part, the rubber membrane, that is in contact with the liquid nitrate ester composition. The configuration and the arrangement of the in-line flow-through chamber, the offtake line, the membrane and the continuous flush-chamber contribute to the practical achievement of the one moving part design.

As shown in FIG. 2, a baffle 2 is incorporated in the downstream line of the flow-through chamber in the sampler. The baffle 2 is located on the downstream side of the sampler and is in the output sample port 13. Baffle 2 serves to increase the upstream pressure in the sampler and to promote back-mixing inside the sampler to obtain representative samples.

Figure 3:
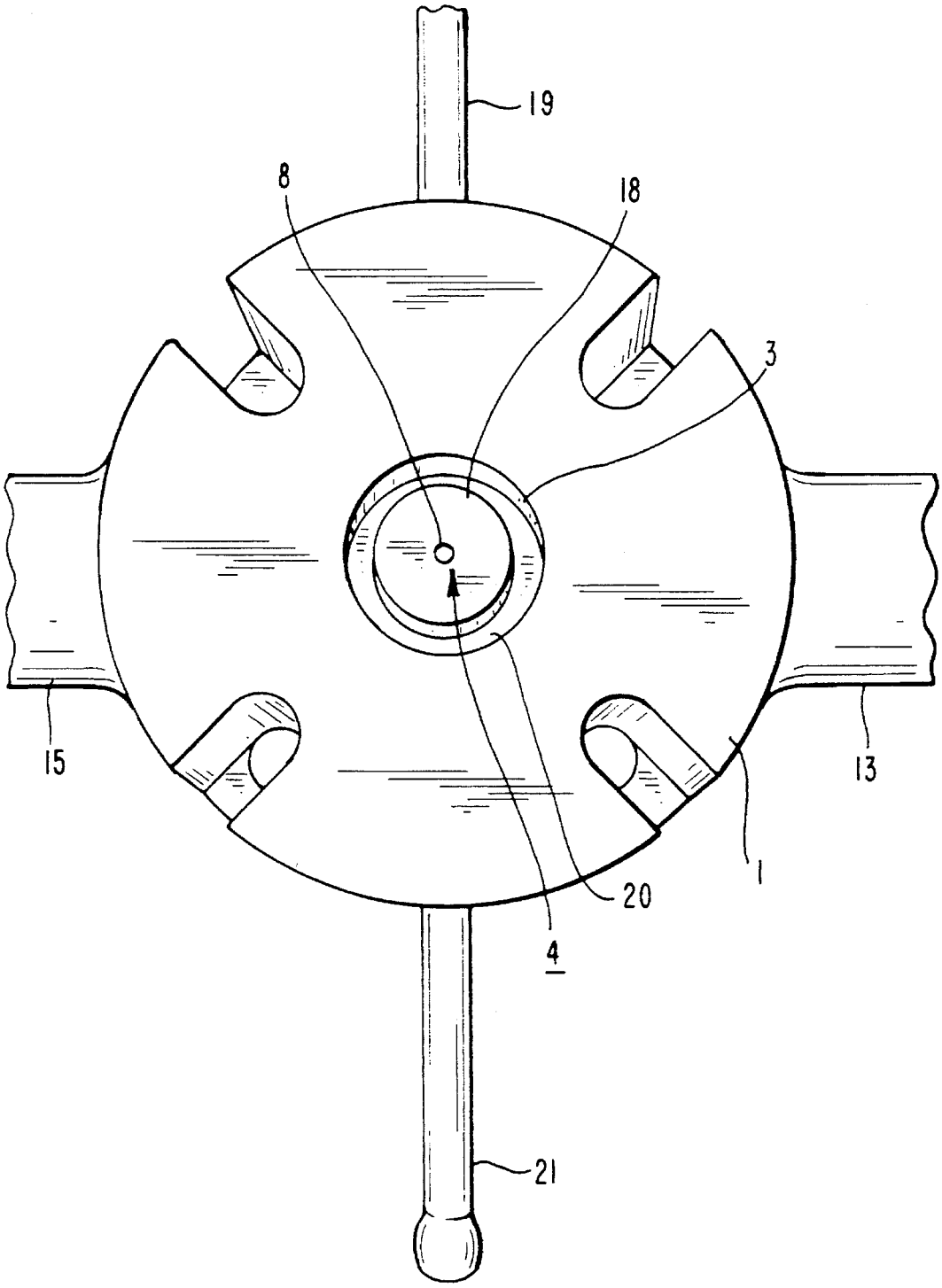

FIG. 3 is a bottom view in perspective of the sampler body 1. This shows the interior construction of the offtake line 8 and the continuous flush chamber 4. The inlet and outlet ports, 15 and 13, of the flow-through chamber are directly connected to each other at the center of the body. There is no other fitting and no other impediment to the flow in the sampler and this allows it to be mounted in-line. The offtake line 8 starts at the flow-through chamber and continues to the bottom of the body. The offtake line is of very small diameter and cross-section compared to the flow-through chamber. The offtake line can be a small hole drilled or bored into the bottom of the block from which the body is made.

The continuous flush chamber 4 has an inlet port 19 which enters the chamber at 19A. The flush chamber is an annular segment concentric with the offtake line. It has an annular cavity which may be formed by boring into the bottom of the block from which the body 1 is made. There is an outlet in the flush chamber which is the beginning of the outlet port 21. The continuous flush chamber has a volume several fold that of the offtake line. Water flows continuously into the chamber. It is intended to sweep the surfaces of the membrane and of the chamber clean and to meet, pick up and continuously remove any liquid nitrate ester or emulsion that may flow out of the offtake line. The continuous flowing action of the flush water is intended to provide a high degree of safety and sampling reliability for the process.

For the embodiment shown in the Figures, the dimensions are to scale. Typical dimensions for the sampler are an overall length of 9 ¾"; the main body being 1 31/32" thick by 3 ⅜" diameter. The cover is ½" thick. The membrane is 0.032" thick by 3 ⅜" diameter. The inlet and outlet lines for the NG emulsion are 1 3/64" I.D. and 1 3/16" O.D. The offtake line for the sample has a 1/16" diameter. The water flush lines have ⅛" I.D. The annular chamber is about 13/32" deep and the channel width is ¼". The offtake line may be inclined to the vertical; an angle of about 17° can be used. The baffle is on the downstream end of the sampler and is about ½ the area of the line. In the cover, the central depression which receives the membrane is about ⅞" diameter and the depression is about 1/16" deep.

The top mounting bracket as shown is a separate piece of metal which is welded to the body; for this construction it is ½" thick and 6" at its maximum length, the holes are 7/16" diameter. In the sampler, all surfaces in contact with the liquid nitrate ester will be rounded to eliminate sharp edges and the surfaces will be very smooth.

Figure 4:
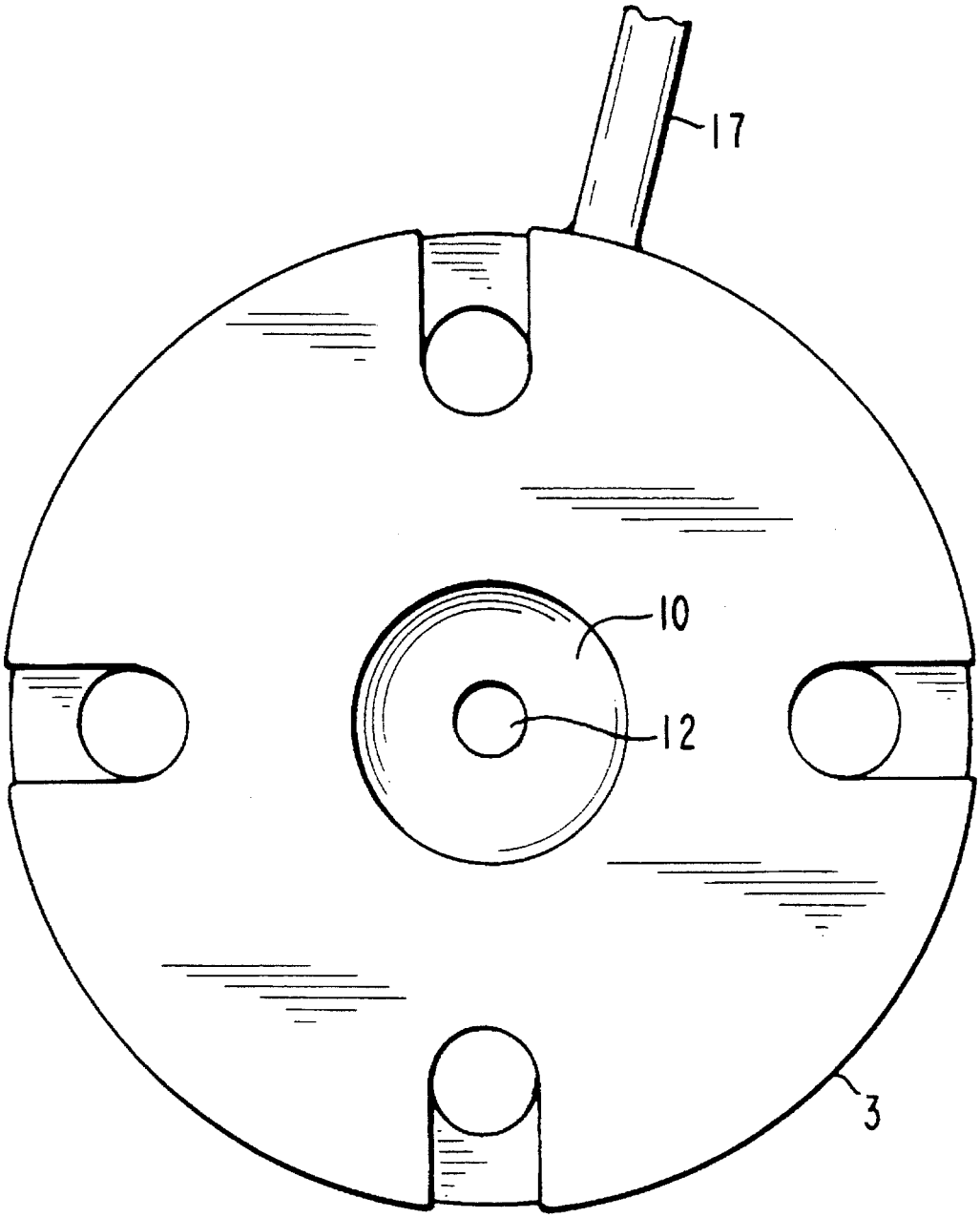

FIG. 4 is a top view of the cover 3 shown in FIGS. 1 and 2. The cover fits to the bottom of the body and as described before will be made from the same block of metal as is used for the body. The bottom cover 3 has a central depression 10 and an opening 12 which is for pressurized water from line 17. The pressurized water will be used to control the position of the membrane and to act as a second safety system in the sampler. The central depression is of a depth to allow for movement of the rubber membrane to an open position from the closed position where the membrane is against the bottom end of the offtake line.

Figure 5:
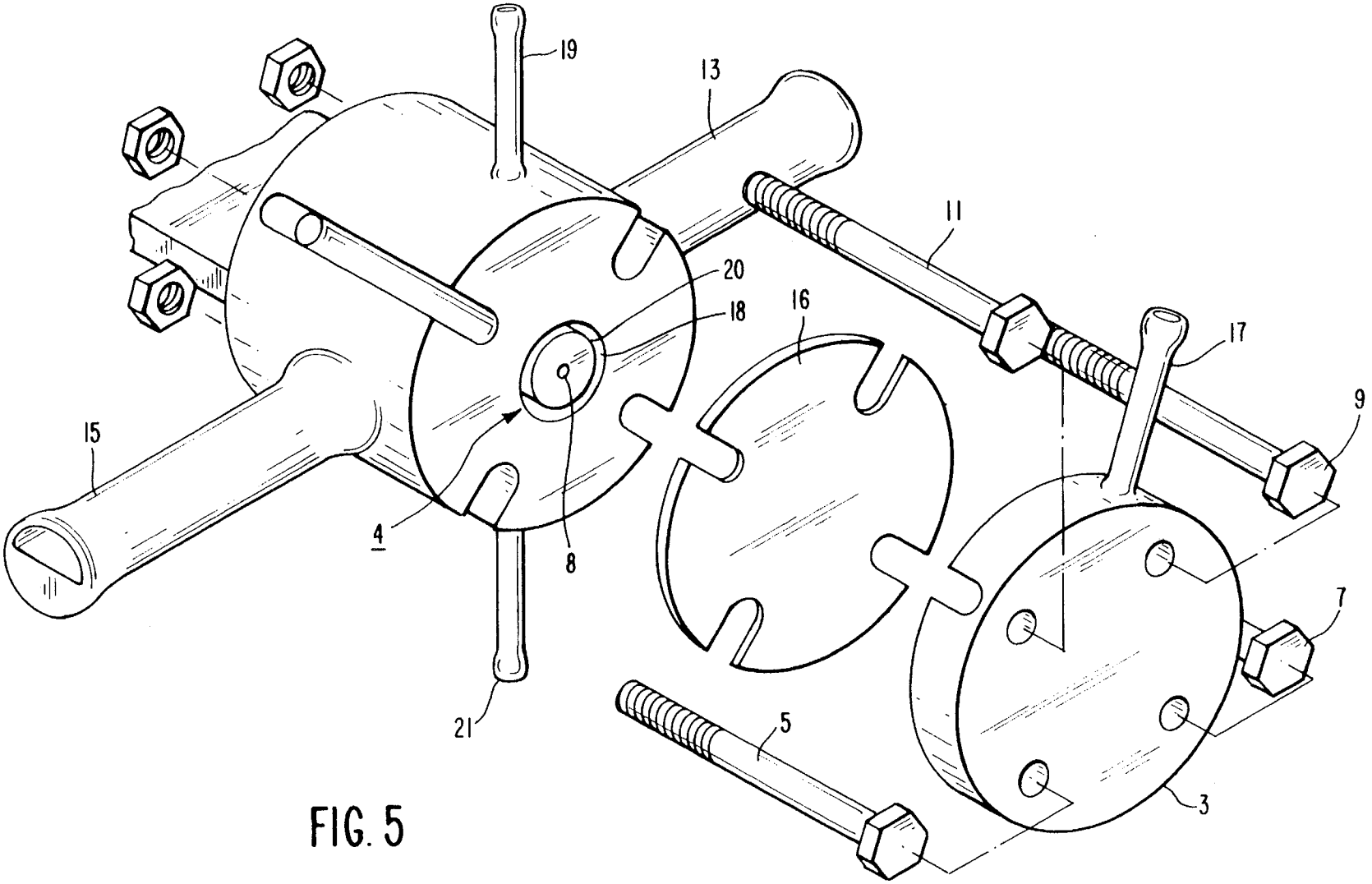

FIG. 5 is an exploded isometric view from the bottom of the sampler of FIGS. 1–4. Similar numbers refer to similar parts. The membrane 16 fits between the body 1 and the cover 3. In the closed position, the membrane will fit against the bottom of the offtake line 8 and the surrounding bottom of the flush chamber. This forms a seal that keeps the offtake line closed. In the closed position, the continuously flowing flush water will sweep and clean the surface of the membrane. If by some accident or defect in material, any emulsion would leak from the offtake line, the flush water would remove it from the sampler and transport it to a collector. This is a fail safe feature of the invention. When a sample from the flow-through chamber is to be taken, the pressure in the water line 17 is reduced for a predetermined period of time. The membrane moves away from the end of the offtake line and allows sample to flow into the flush chamber. A predetermined quantity of sample flows out of line 8 and is drawn into the flush chamber and discharged in line 21.

Figure 6:
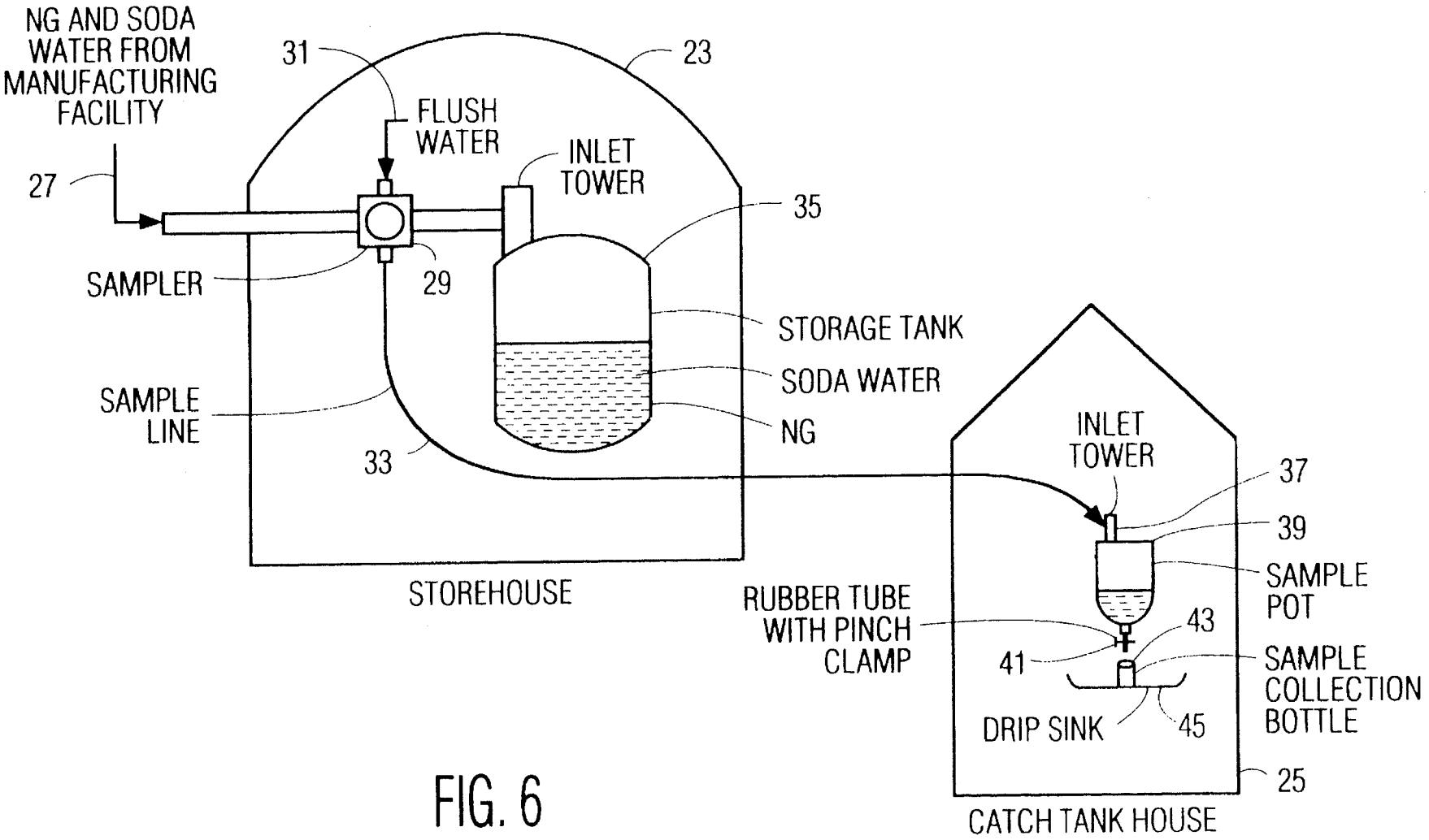

The sampling system of the invention may be installed in accordance with the system shown in FIG. 6. More particularly, a storehouse 23 and a catch tank house 25 are used. An emulsion of NG and soda water from a NG manufacturing facility is fed via transfer line 27 to the sampler shown generally at 29. Flush water is provided to the sampler via line 31 from a source not shown. The outlet side of the sampler is connected to the inlet tower of storage tank 35. Thus, the sampler of the invention is mounted in-line on the transfer line between the outlet line 27 from the manufacturing plant and the storage facility 23.

The sampler output is taken by a sample line 33 from the storehouse 23 to a remote location at the catch tank house 25 where the sample can be collected for analysis and testing. Thus, sample line 33 is connected to the inlet tower 37 of sample pot 39. The sample pot 39 is tapped from a tube and pinch clamp 41 into sample collection bottle 43 in a drip sink 45.

Two independent safety and control systems are provided to operate the sampler and the sampling process of the invention. The first independent safety system is the continuous flush water control system 31 shown here in FIG. 6. As previously described, it provides flush water to transport the NG sample out of the sampler 29 and into the sampler line 33 leading to the sample pot 39 in the adjacent catch tank house 25. The second independent safety system is having the membrane movement controlled by a second independently pressurized water system. Water pressure is applied to the membrane 16 through the water inlet shown in FIG. 5. To open the offtake line and to obtain a sample, the pressure applied on the membrane 16 is relieved on a previously determined pattern during the NG emulsion transfer operation. The pressure in the NG transfer line will force a small quantity of NG emulsion to exit through the offtake line and to flow into the flush chamber. The flush water will continuously flow through the sampler and flush the NG sample out of the flush chamber and into the sample exit line. If transfer line pressure fails, the membrane, under the positive water pressure, will move and close the offtake line. The continuous flow of flush water removes any accidental spills or leaks from the offtake line. Also, the positive water pressure on the membrane will flow water into the flush chamber if any leaks or tears should occur in the membrane.

Figure 7B:
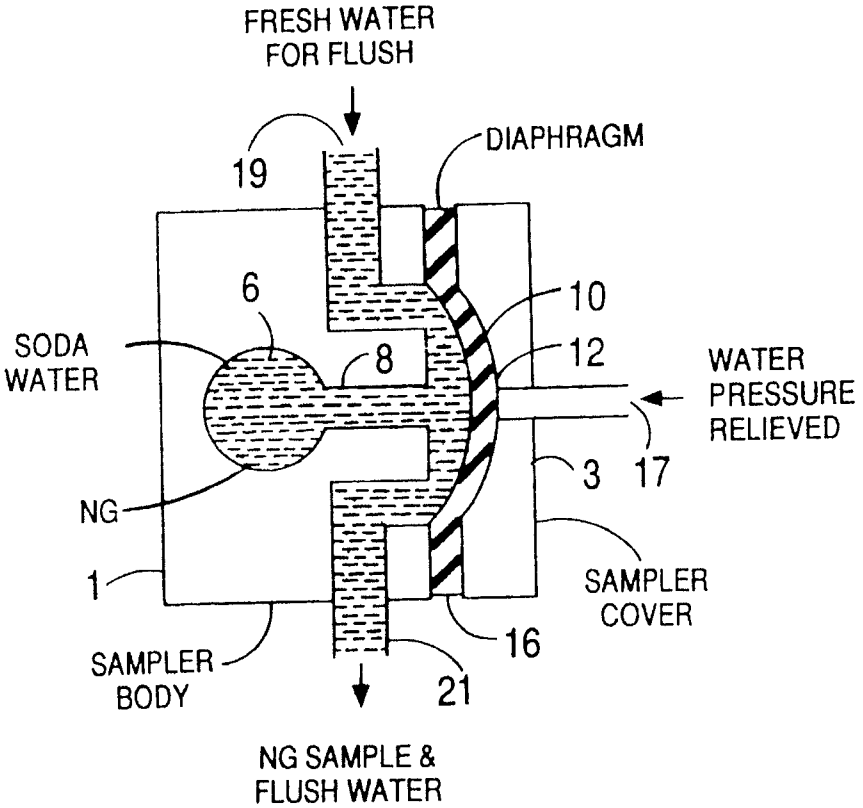
FIGS. 7A and B are views in schematic of the operation of the sampler of the invention.
Figure 7A:
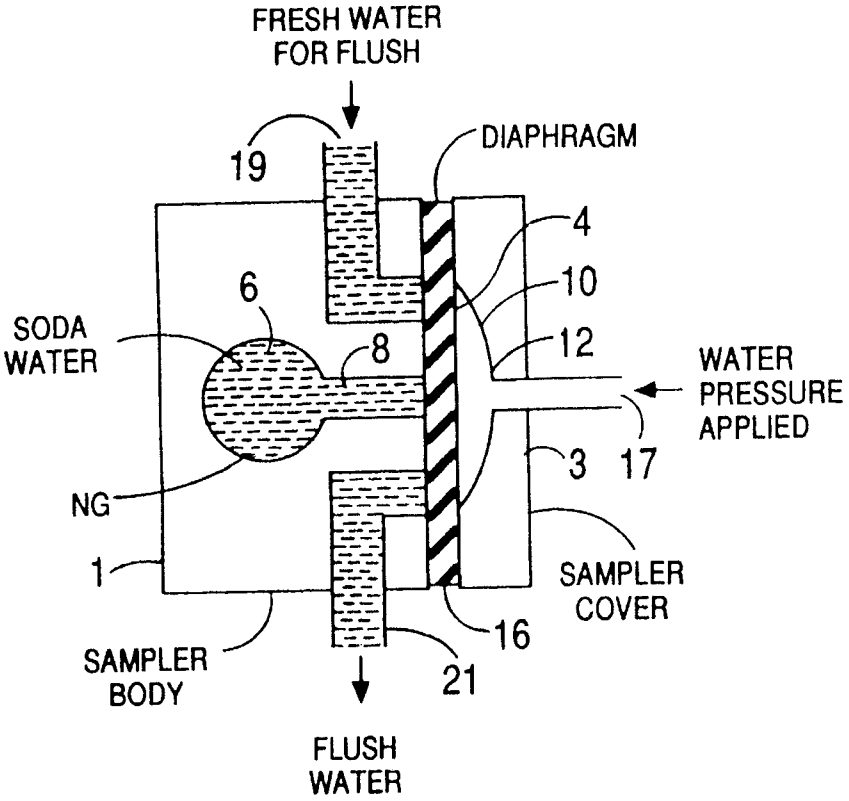

The operation of the sampler system is illustrated in the schematic flow scheme of FIGS. 7A and 7B. FIG. 7A shows the sampler with closed offtake line and continuously flowing flush water. The offtake line is closed by the position of the membrane which is controlled by the water pressure applied at water pressure port 17. In this mode, the membrane 16 is pressed against the bottom of the flush chamber and seals the end of the offtake line. This effects a very strong seal against the offtake line. The NG and soda water in the transfer line is not sampled and flows directly into storage. In FIG. 7B, a sample cycle is shown in which a small sample flows out of the flow-through chamber through the offtake line and into the continuous flush chamber. This occurs when the seal of the membrane is released by movement of the membrane away from the bottom of the flush chamber. This is a result of the reduction in the applied water pressure. Water pressure is relieved at water pressure port 17 to cause the membrane 16 to move away from the offtake line so that the emulsion of NG and soda water from the manufacturing plant can be sampled. The combination of the open and the closed cycles can be varied. This means that a sampling cycle can be developed in which samples of varying size are obtained at different times during the sampling process. Alternatively, samples of the same size may be obtained but the sample time can be varied. A composite sample may be obtained from several small samples.

Figure 8:
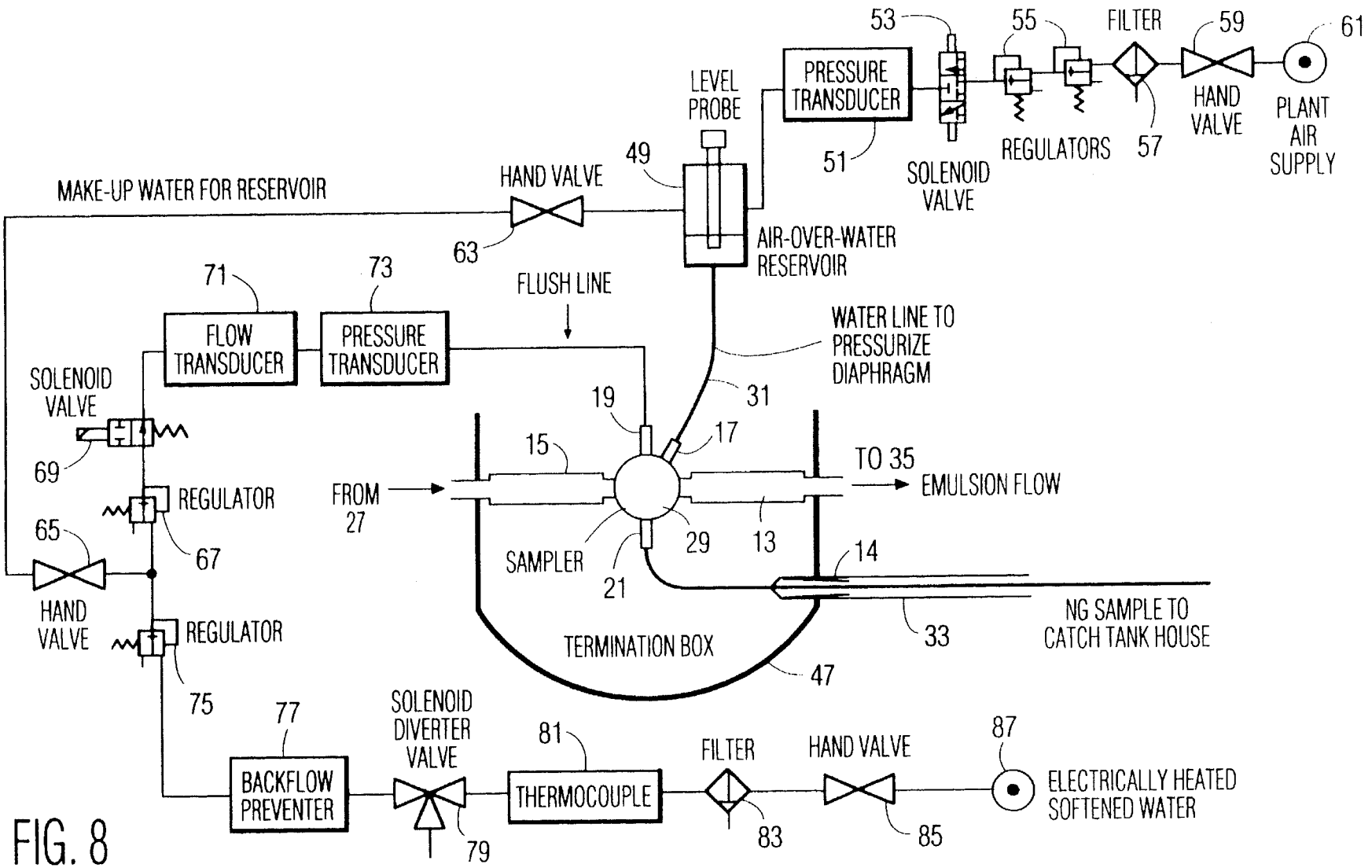

An illustration of the sampling system and a form of instrumentation that may be used to control the sampling system is shown in FIG. 8. As shown, the sampler of the invention is shown generally at 29 and is mounted in a support box 47. The sampler is attached to a transfer line by attaching the ports 15 and 13 to a transfer line 27 which is between a neutralizer and a storage tank 35. Inlet flush port 19 is connected to a source of water. Control water pressure port 17 for the membrane is connected to water line 31. Outlet flush port 21 is connected to sample line 33 to convey the sample to catch tank house 25. The sample line 33 may be connected through the wall of termination box 47 with a fitting shown generally at 14.

The control instrumentation of FIG. 8 uses a source of pressurized air 61 and a source of electrically heated softened water 87. The air line includes an air valve 59, air filter 57, pressure regulators 55, a solenoid control valve 53, and a pressure transducer 51. The air is connected to an air-over-water reservoir 49.

The water line includes a hand valve 85 connected to the water source 87. The valve 85 is connected to a filter 83, a thermocouple 81, a solenoid diverter valve 79, a backflow preventer 77 and a regulator 75. The water is tapped at the output of regulator 75 and is connected to air-over-water reservoir 49 via hand valves 65 and 63. The water is also connected from regulator 75 to another regulator 67, a solenoid valve 69, a flow transducer 71, a pressure transducer to flush port 19. The pressure of the pressurized water is controlled by the control of the pressure of the air which presses the water to the membrane surface.

In the preferred embodiment, a 40 durometer silicone rubber was selected as the material for the membrane. The sampler is also compatible with transfer and sampling of emulsions of diethylene glycol dinitrate (DEGDN) without modification. The silicone rubber diaphragm 16 will be changed once a month as a preventative maintenance measure.

It will be understood that as equivalents of the invention may be made without departing from the spirit and scope of the invention, it is intended in the following claims to protect the substitutions, modifications and variations of materials, elements and process steps as are and will be practiced in this field as well as the specific embodiments described above.

We claim:

1. In a production plant for the manufacture of friction sensitive liquid nitrate esters that are used as energetic liquids, said esters being selected from the group consisting of nitroglycerine and diethylene glycol dinitrate, said plant having a reaction unit to produce compositions of the liquid nitrate esters, a storage unit for storage of said compositions, the improvement comprising having a transfer line connected to the reaction unit, a transfer line connected to the storage unit, and a sampler connected to at least one of the transfer lines, and wherein the sampler is a remotely operable, inline sampler for taking samples of the liquid nitrate ester composition while said composition flows through said transfer line and sampler, the sampler having a flow-through chamber with an offtake line, a moveable membrane and a continuous flush chamber, the membrane being the only moving part in the sampler and the surfaces of the sampler in contact with the liquid nitrate composition being formed from a single piece of stainless steel, and where (a) the flow-through chamber is in line with the transfer line, (b) the offtake line is of very small volume and diameter relative to the flow-through chamber, (c) the membrane is moveable from a closed position at which it closes the bottom of the offtake line and an open position at which a predetermined amount of sample is released from the offtake line, (d) the flush chamber has a continuous water supply and is positioned to flush sample released from the offtake line when the membrane is open and to flush over the membrane when the membrane is closed, and (e) a collector is connected to the sampler for collection of the flush effluent.

2. The plant of claim 1 wherein the membrane is in contact with pressurized water to control the movement of explosive composition through the off-take line.

3. The plant of claim 1 wherein the flush chamber surrounds the offtake line.

4. The plant of claim 1 wherein the sampler is controlled to provide sample sizes from the offtake line in the range of about 20 to about 70 milliliters.

5. In a process for transferring and sampling a friction sensitive composition of a liquid nitrate ester selected from the group consisting of nitroglycerine and diethyl glycol dinitrate, the improvement comprising (a) transferring said composition through a transfer line and a sample zone, the sample zone having a major portion of the composition flow through a chamber inline with the transfer line and having a very small portion of composition flow into a takeoff zone connected to the inline chamber, (b) maintaining a continuous flow of flush water in a flush zone surroundings the takeoff zone, (c) moving a membrane to open said takeoff zone at the bottom thereof to draw a sample of composition and to flush the sample from the takeoff zone with the flush water, (d) moving the membrane to close said takeoff zone and (e) collecting the effluent of sample and flush water, the sampling being conducted under conditions of remote operation.

6. The process of claim 5 wherein the sample is a composite of several cycles of sampling.

7. The process of claim 6 wherein the sample size is in the range of about 20 to about 70 ml.

8. The process of claim 5 wherein the liquid nitrate ester is nitroglycerine.

9. The process of claim 5 wherein the liquid nitrate ester is diethylene glycol dinitrate.

10. The process of claim 5 wherein the composition is in the form of an emulsion of liquid nitrate ester in water.

11. The process of claim 7 wherein the composition is in the form of an emulsion of liquid nitrate ester in water and soda.

* * * * *